United States Patent [19]

Yamada et al.

[11] Patent Number: 4,548,898

[45] Date of Patent: Oct. 22, 1985

[54] PHOTOSENSITIVE MATERIAL FOR DIFFUSION TRANSFER WITH ANTIHALATION LAYER CONTAINING WHITE AND COLOR PIGMENT

[75] Inventors: Motoshige Yamada; Seigo Ebato, both of Nagaokakyo, Japan

[73] Assignee: Mitsubishi Paper Mills, Ltd., Tokyo, Japan

[21] Appl. No.: 515,527

[22] Filed: Jul. 20, 1983

[30] Foreign Application Priority Data

Jul. 27, 1982 [JP] Japan ..... 57-131521

[51] Int. Cl.[4] ..... G03C 1/84; G03C 5/54

[52] U.S. Cl. ..... 430/510; 430/227

[58] Field of Search ..... 430/227, 229, 220, 510

[56] References Cited

U.S. PATENT DOCUMENTS

| | | | |
|---|---|---|---|
| 3,021,214 | 2/1962 | Murphy et al. | 430/227 |
| 3,594,165 | 7/1971 | Rogers | 430/220 |
| 3,740,220 | 6/1973 | De Haes et al. | 430/227 |
| 4,144,064 | 3/1974 | Vermeulen et al. | 430/227 |

*Primary Examiner*—Richard L. Schilling

*Attorney, Agent, or Firm*—Cushman, Darby & Cushman

[57] ABSTRACT

Disclosed is a photosensitive material for silver complex diffusion transfer process which has an antihalation layer which contains a white pigment and a color pigment and has a reflection density of about 0.1 to about 0.3. Preferred white pigment is titanium dioxide and preferred color pigment is carbon black. This photosensitive material has a high sensitivity, a high sharpness and a high resolution.

10 Claims, No Drawings

PHOTOSENSITIVE MATERIAL FOR DIFFUSION TRANSFER WITH ANTIHALATION LAYER CONTAINING WHITE AND COLOR PIGMENT

BACKGROUND OF THE INVENTION

This invention relates to a material for diffusion transfer and, more particularly, to a photosensitive material for the silver complex diffusion transfer.

The principle of the silver complex diffusion transfer process (hereinafter referred to as DTR process) is described in U.S. Pat. No. 2,352,014 and is well known. It is also known that in order to produce a transferred silver image of high contrast and high sharpness on an image-receiving layer, a rapid formation of the transferred silver is necessary. Further, another common means for the formation of a transferred silver image of high sharpness is the utilization of an antihalation layer. As is known well, a black pigment such as carbon black is preferentially used in the antihalation layer of silver halide photographic materials for DTR process, because the black pigment such as carbon black absorbs light over the entire wave length range and because in the photographic materials used in DTR process there is no need to remove the color of antihalation layer by leaching or bleaching during processing steps. However, although effective in improving the sharpness and resolution of a transferred silver image, the antihalation layer has a disadvantage of markedly decreasing the photosensitivity. Further, it is important for a photosensitive material used in DTR process to retain the image reproduction characteristics which permit the photosensitive matrial to reproduce as faithfully as possible the image of an original such as, for example, that involving fine lines of several tens microns in width, particularly when the original contains both the fine lines (black lines) in positive image on a white background and the fine lines (white lines) in negative image on a black background. The image reproducibility is found to become inferior particularly when the photosensitive material has a sensitivity sufficient for photographing an original by the camera work.

The reduction in photosensitivity caused by the antihalation layer can be avoided to a large extent, as described in U.S. Pat. No. 4,144,064, by providing between the antihalation layer and the silver halide emulsion layer an intermediate layer containing a white pigment such as titanium dioxide. There is also known a material for DTR process, wherein an antihalation layer and a white pigment layer are provided, in the order indicated, on a support and overlaid with a silver halide emulsion layer. Although having an advantage of reproducing an image excellent in sharpness and resolution, without a large decrease in sensitivity, such materials for the diffusion transfer process were found to have the following various disadvantages: The antihalation layer of such a material contains a reduced amount of a black pigment per unit area and, when overlaid with a layer of a large amount of a white pigment, tends to reveal unevenness in the coating and occurrence of streaks on the surface. Part of the black pigment sometimes diffuses into the white pigment layer to decrease the hiding power of the white pigment, to decrease the photosensitivity, or to cause uneven density, thus making it comparatively difficult to manufacture a photosensitive material with satisfactory reproducibility. The drying of the antihalation layer and the white pigment layer consumes a good amount of heat energy and, in addition, the dried pigment layer causes a reduction in the adherence of the layer to a hydrophilic colloid layer such as, for example, a silver halide emulsion layer, resulting in even poor adhesion of the emulsion to the white pigment layer in coating operation. When the diffusion transfer development is performed by using the defective photosensitive and image receiving materials, at least one of the above disadvantages gives rise to the occurrence of streaks on the image-receiving material caused by the faulty transfer.

SUMMARY OF THE INVENTION

An object of the present invention is to provide a photosensitive material for diffusion transfer having a high sensitivity, a high sharpness, and a high resolution, wherein the aforementioned disadvantages have been largely removed.

DESCRIPTION OF THE INVENTION AND THE PREFERRED EMBODIMENTS

It was found that the aforementioned difficulties can be overcome by incorporating the white pigment layer with a color pigment in an amount considerably smaller than that used per unit area of the conventional antihalation layer. Such a layer containing both the white pigment and the color pigment has a reflection optical density of about 0.1 to about 0.3. According to this invention, there is provided a photosensitive material for diffusion transfer having an antihalation layer which contains a white pigment and a color pigment and has a reflection density of about 0.1 to about 0.3. The color pigment content of the single antihalation layer of this invention is reduced to 1/10–1/100 of amount necessary for the conventional antihalation layer, without causing substantial loss in both the photosensitivity and the antihalation effectiveness. It can be applied to form a coating layer of uniform density which is produced with satisfactory reproducibility. Moreover, the single antihalation layer improves the adhesion of a hydrophilic colloid layer provided thereon, resulting in a photosensitive material for diffusion transfer, which is improved in interlayer adhesion. When such a photosensitive material is subjected to the diffusion transfer development, there is produced on the image-receiving material an image of good quality, the streaks caused by faulty transfer having mostly disappeared.

A preferred white pigment for use in the present antihalation layer is titanium dioxide, either of the anatase type or rutile type, though other inorganic white pigments such as zinc oxide, calcium carbonate, and calcium sulfate can be used. The amount used of an inorganic white pigment in the antihalation layer is preferably in the range of from about 5 to about 20 $g/m^2$. The average particle size is preferably about 0.05 to about $5\mu$.

The color pigment to be used in combination with the white pigment may be any of those having an absoprtion corresponding to the photosensitive range of a silver halide emulsion layer and is preferably a black pigment such as carbon black. As described previously, the amount used of a color pigment can be reduced to a value much smaller than that used in the conventional antihalation layer. In the present antihalation layer, the amount of a black pigment is about 0.01 to about 0.0001 part by weight for 1 part by weight of a white pigment, depending to some degree upon the type and amount of the latter. The black pigment content of the present antihalation layer is normally in the range of from about 0.0001 to about 0.1 g/m$^2$. The amount corresponding to a reflection optical density of about 0.1 to about 0.3 can be easily determined by a simple experiment by taking into account both the photosensitivity and the antihalation effect.

The antihalation layer of this invention is preferably a dispersion of the pigments in those hydrophilic binders which are exemplified below in connection with a photosensitive emulsion. The weight ratio of a pigment to the hydrophilic binder is in the range of from about 1 to about 10. A silver halide emulsion layer is provided on the antihalation layer either directly or through an intermediate layer.

The hydrophilic binders advantageously used in preparing photosensitive emulsions include lime-treated gelatin, acid-treated gelatin, and gelatin derivatives described in, for example, Japanese Patent Publication Nos. 4,854/63, 5,514/64, 12,237/65 and 26,345/67; U.S. Pat. Nos. 2,525,753, 2,594,293, 2,614,928, 2,763,639, 3,118,766, 3,132,945, 3,186,846, and 3,312,553; Brit. Pat. Nos 861,414 and 1,033,189; proteins such as albumin and casein; cellulose derivatives such as carboxymethylcellulose and hydroxyethylcellulose; natural polymers such as agar and sodium alginate; and synthetic hydrophilic binders such as polyvinyl alcohol, poly-N-vinylpyrrolidone, polyacrylic acid copolymers, polyacrylamide, derivatives thereof, and partial hydrolyzates thereof. These hydrophilic binders are used each alone or in combinations. They are also used advantageously in preparing nonphotosensitive layers such as antihalation layer, intermediate layer, protective layer (or strippable layer), backing layer, and image-receiving layer.

The binder in the silver halide emulsion layer is used in a weight ratio of 0.3–5, preferably 0.5–3, based on the silver halide in terms of silver nitrate. The coverage of silver halide is usually 0.5 to about 5 g/m$^2$. The silver halide may be any of the silver chloride, silver bromide, silver chlorobromide, and mixtures of these halides with silver iodide. The silver halide emulsion can be spectrally sensitized to blue, green, or red with merocyanine, cyanine, or other sensitizing dyes. The emulsion can also be chemically sensitized with various sensitizers such as, for example, sulfur-containing sensitizers (e.g. sodium thiosulfate, thiourea, or gelatin containing labile sulfur), noble metal sensitizers (e.g. gold chloride, gold thiocyanate, ammonium chloroplatinate, silver nitrate, silver chloride, palladium salts, rhodium salts, iridium salts, and ruthenium salts), polyalkylenepolyamine compounds described in U.S. Pat. No. 2,518,698; imino-amino-methanesulphinic acid described in German Pat. No. 1,020,864; and reductive sensitizers (e.g. stannous chloride).

The backing layer preferably provided on the back side of the support should contain a hydrophilic colloid in an amount necessary to counterbalance the curling stress exerted by coating layers provided on the photosensitive side, said amount being dependent upon the amounts of hydrophilic colloids and an inorganic white pigment contained in said coating layers.

The constituent members of the present photosensitive material may contain various other additives such as, for example, hardening agents including formaldehyde, mucochloric acid, chrome alum, vinylsulfone compounds, epoxy compounds, and ethyleneimine compounds; antifoggants or stabilizers including mercapto compounds and tetrazaindene; surface active agents including saponin, sodium alkylbenzenesulfonates, and salts of sulfosuccinate esters; anionic compounds such as alkylarylsulfonates described in U.S. Pat. No. 2,600,831; amphoteric compounds such as those described in U.S. Pat. No. 3,133,816; wetting agents including waxes, polyol compounds, glycerides of higher fatty acids, and esters of higher alcohols; mordants including N-guanylhydrazone compounds, quaternary onium compounds, and tertiary amine compounds; antistatic agents such as diacetylcellulose, styrene-perfluoroalkylene sodium maleate copolymers, alkali metal salts of the reaction products of a styrene-maleic anhydride copolymer and p-aminobenzenesulfonic acid; matting agents including polymethacrylate esters, polystyrene, and colloidal silica; improving agents for film properties such as acrylate esters and a variety of latices; thickners such as styrene-maleic acid copolymers and substances described in Japanese Patent Publication No. 21,574/61; antioxidants, developing agents, and pH regulators.

A plurality of hydrophilic colloid layers may be applied either separately or by simultaneous multiple coating. The coating can be carried out by any of the known methods without limitation.

The processing solutions for the DTR process may contain alkaline substances, e.g. sodium hydroxide, potassium hydroxide, lithium hydroxide, and trisodium phosphate; silver halide solvents, e.g. sodium thiosulfate, ammonium thiocyanate, cyclic imide compounds, and thiosalicylic acid; preservatives, e.g. sodium sulfite; thickeners, e.g. hydroxyethylcellulose and carboxymethylcellulose; antifoggants, e.g. potassium bromide and 1-phenyl-5-mercaptotetrazole; development modifiers, e.g. polyoxyalkylene compounds and onium compounds; developing agents, e.g. hydroquinone and 1-phenyl-3-pyrazolidone; and alkanolamines.

A strongly alkaline processing solution containing a developing agent has a disadvantage in that the developing agent tends to be deactivated by atmospheric oxidation. Such a disadvantage can be avoided to a great extent by incorporating the developing agent into DTR materials such as silver halide emulsion layer or/and a hydrophilic colloid layer in water-permissible relation thereto. In developing such a diffusion transfer material containing a developing agent, use is made of an alkaline activating solution containing no or substantially no developing agent. As for the DTR process employing an alkaline activating solution, reference may be made of Japanese Patent Publication Nos. 27,568/64, 30,856/72, and 43,778/76.

The invention is illustrated below with reference to Examples.

EXAMPLE 1

On one side of a subbed sheet of polyethylene terephthalate film, 100$\mu$ in thickness, there was applied by means of a sliding hopper extrusion coater a double layer consisting of an antihalation layer containing essentially 0.5 g/m$^2$ of carbon black and 3 g/m$^2$ of gelatin and a superposed layer containing essentially 10 g/m$^2$ of titanium dioxide and 3 g/m$^2$ of gelatin. A backing layer of 8 g/m$^2$ of gelatin was provided on the back side of the coated sheet. The titanium dioxide layer of the resulting coated sheet was then overlaid with a double layer consisting of a direct-positive silver halide emulsion layer containing silver chloride as major component and a protective gelatin layer to prepare a reference specimen.

A specimen according to the present invention was prepared in the same manner as described above, except that said double layer consisting of the antihalation layer and the superposed layer was replaced with an antihalation layer containing essentially 0.02 g/m$^2$ of carbon black, 10 g/m$^2$ of titanium dioxide, and 3 g/m$^2$ of gelatin.

Both specimens showed a reflection optical density of about 0.2. The reference specimen showed many coating streaks on the antihalation layer accompanied with uneven coating. Moreover, it showed unevenness of the emulsion coating caused by poor adhesion of the coating layer. The image-receiving layer treated by the customary DTR process showed streaks consisting of minute spots of faulty transfer. To the contrary, the specimen prepared according to the present invention showed none of the coating abnormalities such as uneven coating and occurrence of coating streaks; the emulsion coating layer was uniform. Upon development, there was produced on the image receiving layer a good-quality transferred image without showing any abnormality. The photosensitivity, sharpness and resolution of the specimen were favorably comparable to those of the reference specimen.

EXAMPLE 2

The procedure of Example 1 was repeated, except that a paper support coated on both sides with a polyethylene resin was used. The results obtained were substantially the same as those obtained in Example 1.

EXAMPLE 3

The procedure of Example 2 was repeated, except that an antihalation layer containing essentially 0.005 g/m$^2$ of carbon black, 6 g/m$^2$ of titanium dioxide, 2 g/m$^2$ of gelatin, and 0.2 g/m$^2$ of triethylene glycol was provided on the coated paper support. The results obtained were substantially the same as those obtained in Example 2.

What is claimed is:

1. A photosensitive material for silver complex diffusion transfer process which comprises a support and at least an antihalation layer provided on the support and a silver halide emulsion layer provided on the antihalation layer, said antihalation layer consisting essentially of a hydrophilic binder, a white pigment and a color pigment, and having a reflection density of about 0.1 to about 0.3 and weight ratio of the total pigment to the hydrophilic binder being about 1 to about 10.

2. A photosensitive material according to claim 1 wherein the white pigment is titanium dioxide.

3. A photosensitive material according to claim 1 wherein amount of the white pigment is about 5 to about 20 g/m$^2$.

4. A photosensitive material according to claim 1 wherein the white pigment has an average particle size of about 0.05 to about 5$\mu$.

5. A photosensitive material according to claim 1 wherein the color pigment is carbon black.

6. A photosensitive material according to claim 1 wherein weight ratio of the white pigment to the color pigment is 1: about 0.01 to about 0.0001.

7. A photosensitive material according to claim 1 wherein amount of the color pigment is about 0.0001 to about 0.1 g/m$^2$.

8. A photosensitive material according to claim 1 wherein the color pigment is carbon black and the white pigment is titanium dioxide.

9. A photosensitive material according to claim 8 wherein the weight ratio of the titanium dioxide to carbon black is 1: about 0.01 to about 0.0001.

10. A photosensitive material according to claim 8 wherein the amount of titanium dioxide is about 5 to about 20 g/m$^2$.

* * * * *